US007228687B2

(12) United States Patent
Ehrne

(10) Patent No.: US 7,228,687 B2
(45) Date of Patent: Jun. 12, 2007

(54) VALVE DEVICE

(75) Inventor: Florian Ehrne, Feldkirch (AT)

(73) Assignee: VAT Holding AG, Haag (CH)

( * ) Notice: Subject to any disclaimer, the term of this patent is extended or adjusted under 35 U.S.C. 154(b) by 371 days.

(21) Appl. No.: 10/916,698

(22) Filed: Aug. 12, 2004

(65) Prior Publication Data

US 2006/0032240 A1 Feb. 16, 2006

(51) Int. Cl.
*B01D 8/00* (2006.01)

(52) U.S. Cl. ..... 62/55.5

(58) Field of Classification Search ..... 62/55.5
See application file for complete search history.

(56) References Cited

U.S. PATENT DOCUMENTS 4,718,240 A * 1/1988 Andeen et al. ..... 62/55.5
5,862,671 A * 1/1999 Lessard et al. ..... 62/55.5
5,906,102 A * 5/1999 Bartlett et al. ..... 62/55.5
6,327,863 B1 * 12/2001 Yamartino et al. ..... 62/55.5
2005/0204753 A1 * 9/2005 Bartlett et al. ..... 62/55.5

* cited by examiner

*Primary Examiner*—William C. Doerrler
(74) *Attorney, Agent, or Firm*—Reed Smith LLP

(57) ABSTRACT

A valve device, according to the invention, for connecting to a cryopump, wherein the valve device comprises a body with a through-channel and a connection flange at one end of the through-channel for connecting to a backing pump connection flange of the cryopump; a pressure relief valve which opens when an overpressure in the through-channel exceeds a limiting valve and which lets this overpressure out of the through-channel; a purge gas line in which a purge gas valve is arranged and which serves to supply a purge gas to a supply line of the cryopump during a regeneration process of the cryopump; wherein an end portion of the purge gas line by which the purge gas line can be connected to the supply line of the cryopump runs within the through-channel to the area of the end of the through-channel situated in the connection flange. A pump arrangement according to the invention is also disclosed.

24 Claims, 6 Drawing Sheets

VALVE DEVICE

BACKGROUND OF THE INVENTION a) Field of the Invention

The invention is directed to a valve device for connecting to a cryopump. The invention is further directed to a pump arrangement comprising a cryopump with a backing pump connection flange to which a valve device is connected.

The valve device comprises a purge gas line in which a purge valve is arranged and which serves to supply a purge gas to the cryopump during a regeneration process of the cryopump.

b) Description of the Related Art

Cryopumps are known. They have cooled adsorption surfaces for adsorbing gases. A regeneration in which the adsorption surface is heated is occasionally required. Adsorbed gas containing hydrogen, for example, is released during regeneration. In order to prevent any risk owing to released gas, for example, to prevent the risk of explosion, a purge gas which dilutes the released gas is supplied during regeneration of the cryopump. The purge gas is an inert gas, usually nitrogen. A supply line arranged inside the cryopump serves to supply the purge gas to the adsorption surfaces. In known cryopumps, a connection flange is arranged at the housing of the cryopump. A purge gas line through which the purge gas is supplied can be connected to the supply line by means of the connection flange. A purge gas valve which can be opened and closed is arranged in the purge gas line.

The gas released during the regeneration process, together with the supplied purge gas, leads to an overpressure which is relieved through a pressure relief valve. This pressure relief valve is usually arranged at an intermediate piece which is connected to a backing pump connection flange of the cryopump on one side and to a backing pump valve on the other side. The backing pump valve leads to a backing pump by means of which the cryopump and a vacuum chamber to which the cryopump is connected can be pumped down to a pre-vacuum or roughing pressure. The backing pump valve is usually constructed as an angle valve or corner valve.

As a further safety precaution, a diluting gas which is an inert gas, usually nitrogen, is mixed in with the gas flowing out of the pressure relief valve during a regeneration process of the cryopump.

Servicing or exchange of the cryopump in a conventional pump arrangement of the kind described above is relatively complicated because of the parts to be disassembled.

OBJECT AND SUMMARY OF THE INVENTION

One object of the invention is to simplify servicing or exchange of a cryopump.

Another object of the invention is to provide a more compact valve device for connecting to a cryopump.

Another object of the invention is to reduce the quantity of required seals and connections in a cryopump with a valve device connected to it.

Another object of the invention is to make it possible to simplify a valve device for connecting to a cryopump.

A valve device, according to the invention, for connecting to a cryopump comprises a body with a through-channel and a connection flange at one end of the through-channel for connecting to a backing pump connection flange of the cryopump; a pressure relief valve which opens when the overpressure in the through-channel exceeds a limiting valve and which lets this overpressure out of the through-channel; a purge gas line in which a purge gas valve is arranged and which serves to supply a purge gas to a supply line of the cryopump during a regeneration process of the cryopump; wherein an end portion of the purge gas line by which the purge gas line can be connected to the supply line runs within the through-channel to the area of the end of the through-channel situated in the connection flange.

A pump arrangement, according to the invention, with a cryopump having a backing pump connection flange and with a valve device connected to the backing pump connection flange comprises a body of the valve device with a through-channel and a connection flange at one end of the through-channel for connecting to the backing pump connection flange of the cryopump; a purge gas line of the valve device in which a purge gas valve is arranged and which serves to supply a purge gas to a supply line of the cryopump during a regeneration process of the cryopump; wherein an end portion of the purge gas line runs within the through-channel of the body of the valve device and wherein the end portion of the purge gas line is connected to an end portion of the supply line when the connection flange of the body is connected to the backing pump connection flange of the cryopump, and a continuous line is formed for the purge gas.

In a device according to the invention, when the body of the valve device is connected to the cryopump a connection of the purge gas line of the valve device to the supply line of the cryopump is accordingly carried out at the same time. This facilitates assembly when installing the cryopump and when disassembling it subsequently for maintenance purposes. It is not necessary for the connection between the purge gas line and the supply line to be completely tight.

In a preferred embodiment example of the invention, the body also has a dilution gas line in which a dilution gas valve is arranged, so that a dilution gas flowing out of the dilution gas line can be mixed in with the gas flowing through the pressure relief valve by means of the dilution gas line.

In a particularly advantageous embodiment form of the invention, a closure member is adjustably mounted in the body and the through-channel of the body can be closed and opened by means of this closure member. The body accordingly forms a valve body (or a valve housing) of a backing pump valve by means of which the connection to a backing pump can be blocked or released. The backing pump valve is advantageously constructed in the manner of an angle-valve or corner valve. Further, the purge valve is advantageously arranged at the body. Further, the dilution gas valve can advantageously be arranged at the body. In this way, a valve device which is very compact in its entirety and which is very easy to mount on and remove from the cryopump can be provided for connecting to the cryopump.

Further advantages and details of the invention will be described in the following with reference to the embodiment example shown in the drawings, further objects of the invention following therefrom.

DESCRIPTION OF THE PREFERRED EMBODIMENT EXAMPLES

Figure 9:
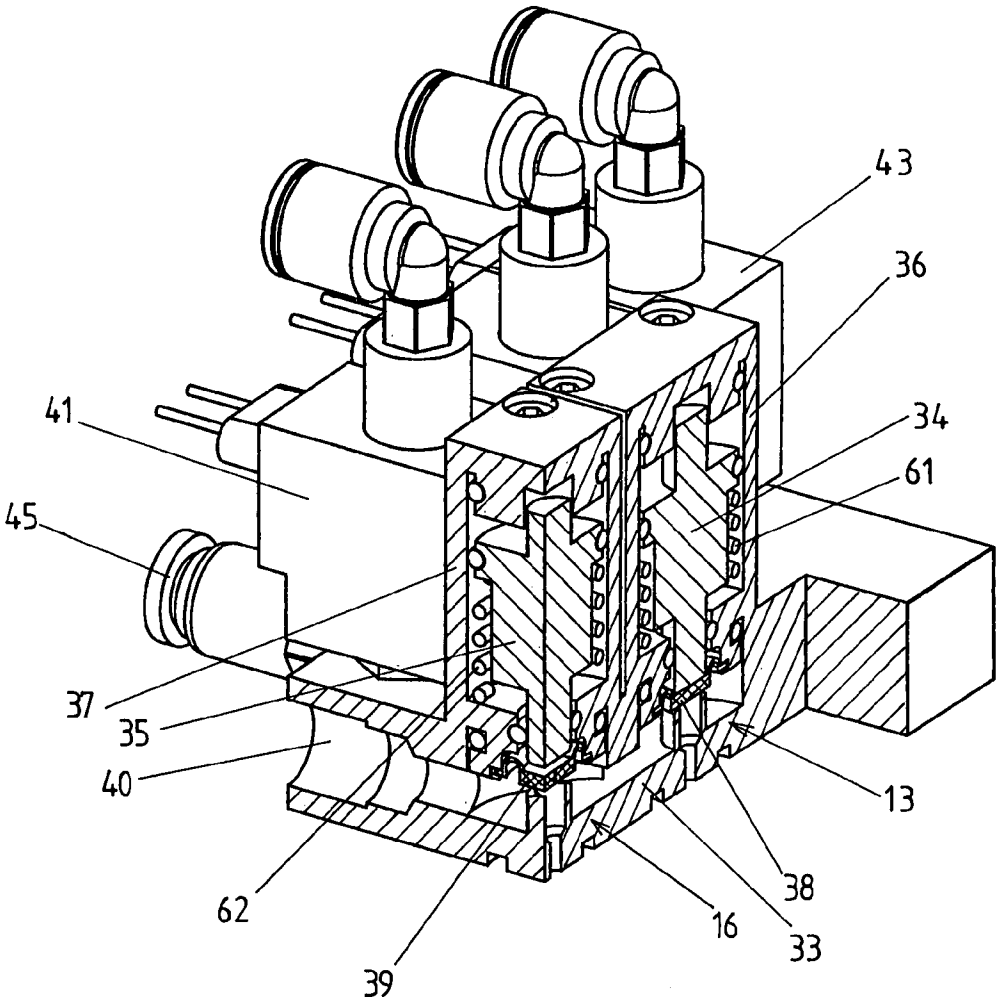
FIG. 9 is a perspective view of a section through the purge gas valve and the dilution gas valve, wherein parts which are shown in section and are rigidly connected to one another are shown as one piece for the sake of clarity and simplicity.
Figure 1:
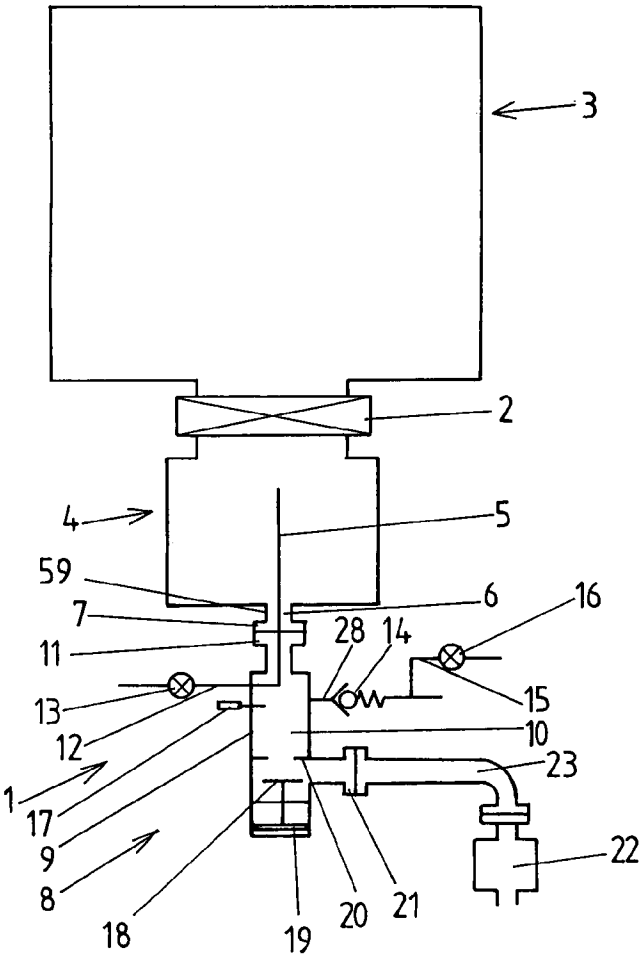
FIG. 1 is a highly schematic view of a pump arrangement, according to the invention, which is connected to a vacuum chamber by a cut-off valve.
Figure 3:
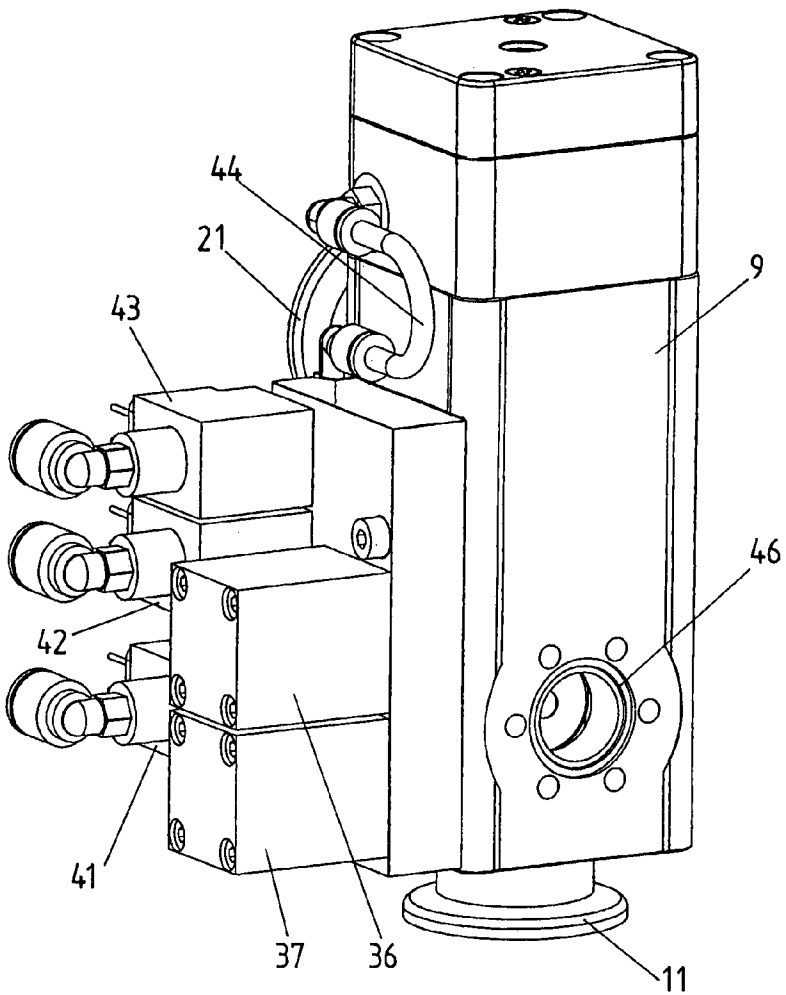
FIGS. 2 and 3 are perspective views of a valve device according to the invention from different viewing angles.
Figure 2:
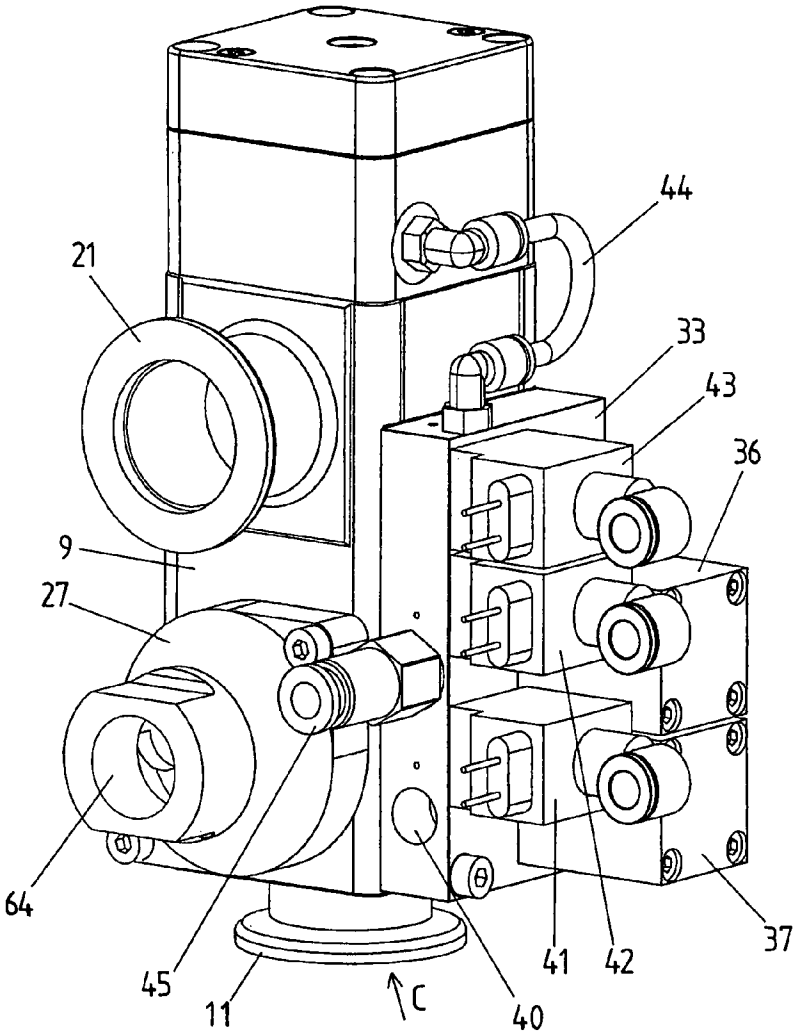

For the description of an embodiment example of the invention, reference is had first to the highly schematic and simplified FIG. 1 which shows a pump arrangement 1 connected to a vacuum chamber 3 by a cut-off valve 2. The pump arrangement comprises a cryopump 4 which can be constructed in a conventional manner except for the arrangement of the supply line 5 for a purge gas. The cryopump 4 has a backing pump channel 6 which extends inside a connection sleeve 59 that opens out at a backing pump connection flange 7 arranged at the connection sleeve 59.

The pump arrangement 1 further comprises a valve device 8 for connecting to the cryopump 4. The valve device 8 has a body 9 with a through-channel 10 and a connection flange 11 at one end of the through-channel 10. The connection flange 11 of the body 9 of the valve device 8 is connected to the backing pump connection flange 7 of the cryopump 4.

The valve device 8 further comprises a purge gas line 12 in which a purge gas valve 13 is arranged. The purge gas line 12 serves to supply a purge gas to the cryopump during a regeneration of the cryopump. For this purpose, the purge gas line 12 is connected to the supply line 5 as will be described more fully hereinafter.

The valve device 8 further comprises a pressure relief valve 14 through which overpressure can be let off from the through-channel 10 through an overpressure outlet channel 28. Overpressure of this type occurs during a regeneration process of the cryopump 4.

The valve device 8 further comprises a dilution gas line 15 in which a dilution gas valve 16 is arranged. When the dilution gas valve 16 is opened, a dilution gas which flows in through the dilution gas line 15 and out of the latter can be mixed with the gas flowing off through the pressure relief valve 14.

The purge gas and the dilution gas are inert gases. The same gas, preferably nitrogen, can be used for both gases.

The pressure in the through-channel 10 can be picked up by means of a pressure sensor 17.

A closure member 18 is adjustably mounted in the body 9. The through-channel 10 can be closed and opened by means of this closure member 18. The closure member 18 is adjustable between the open position and closed position by means of an actuating member 19 which is constructed as a piston-cylinder unit in the present embodiment example. In the closed position, the closure member 18 contacts a valve seat 20. A vacuum valve is formed in this way.

At the other end of the through-channel 10, the body 9 has another connection flange 21 for connecting a backing pump 22. The backing pump 22 is connected to the body 9 by a line piece 23.

When the closure member 18 is open, the cryopump 4 can be pumped down to a roughing pressure by the backing pump 22 and when the cut-off valve 2 is open the vacuum chamber 3 can also be pumped down to a roughing pressure by the backing pump 22.

The body 9 and the closure member 18 which is adjustably arranged therein are constructed in the manner of a corner valve, i.e., the body 9 has two portions at an angle to one another, preferably at right angles to one another, through which a portion of the through-channel 10 extends, and the closure member is adjustable in axial direction of the one portion of the body 9 and through-channel 10, respectively, and can contact the valve seat 20 and be lifted from the latter.

The valve device is shown more exactly in FIGS. 2 to 9, wherein the parts described above with reference to FIG. 1 are provided with the same reference numbers and are shown in more detail.

Figure 5:
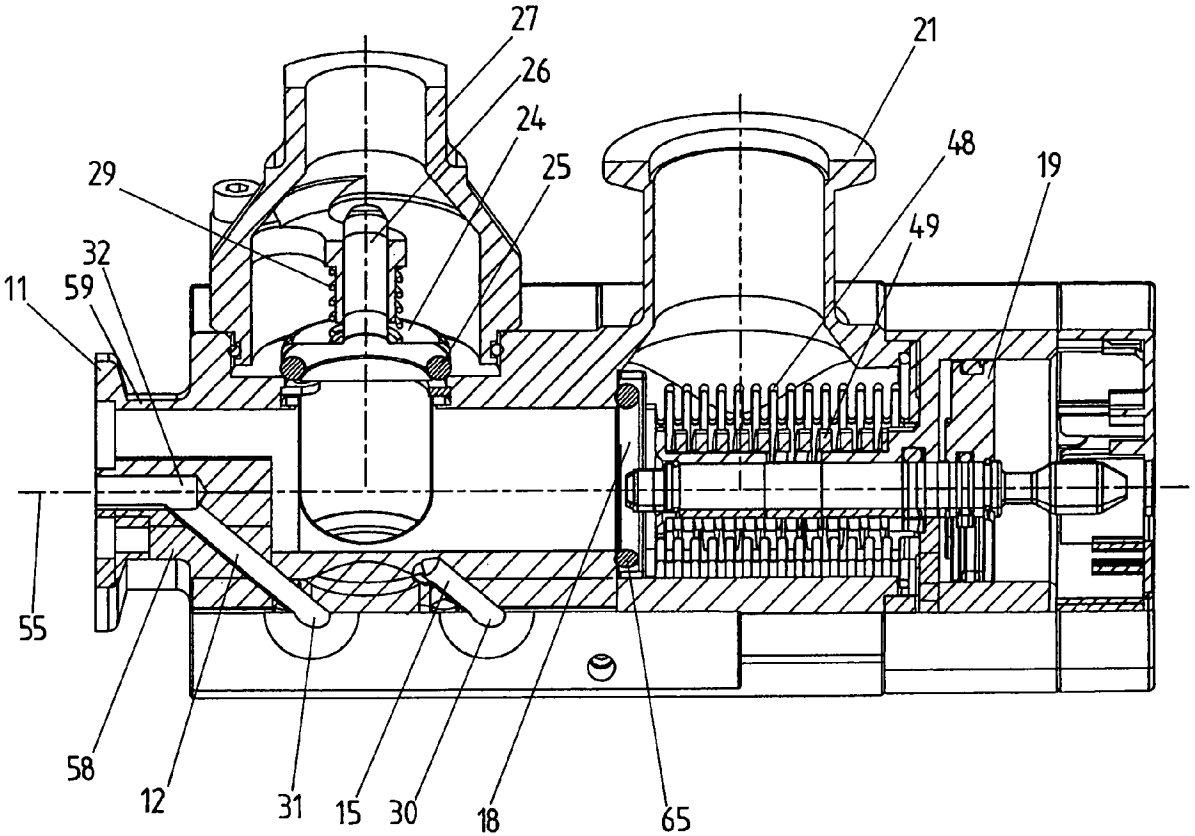
FIG. 5 shows a section along line A-A of FIG. 4.
Figure 4:
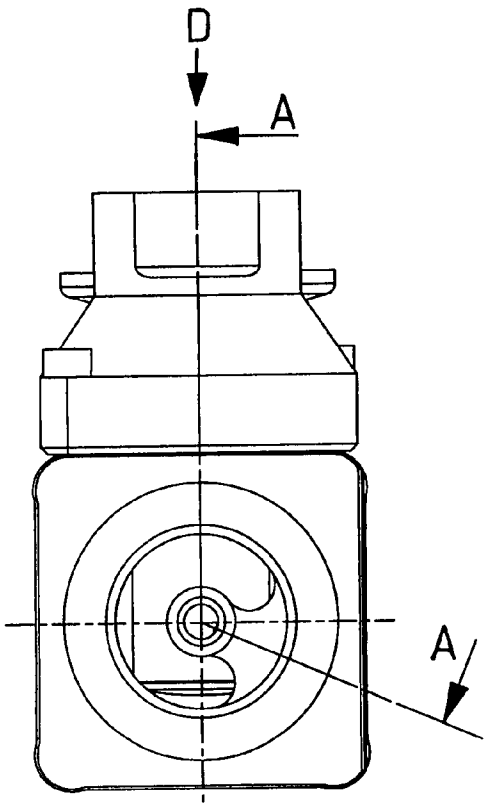
FIG. 4 is a front view of the valve device in FIGS. 2 and 3 (viewing direction C) without the purge gas valve, the dilution gas valve and the control valves.

The construction of the pressure relief valve 14 in the shape of a self-locking check valve is shown more exactly in FIG. 5, for example. The pressure relief valve 14 has a valve disk 24 with a sealing ring 25 arranged thereon and a valve stem 26 which projects from the valve disk and which is displaceably mounted in an outlet connection piece 27 that is fastened to the body 9, the overpressure outlet channel 28 extending through this outlet connection piece 27. The valve disk 24 is acted upon by means of a spring 29 in its closed position against a valve seat at the body 9. A connection 64 for an exhaust gas line is formed at the outlet connection piece.

Figure 7:
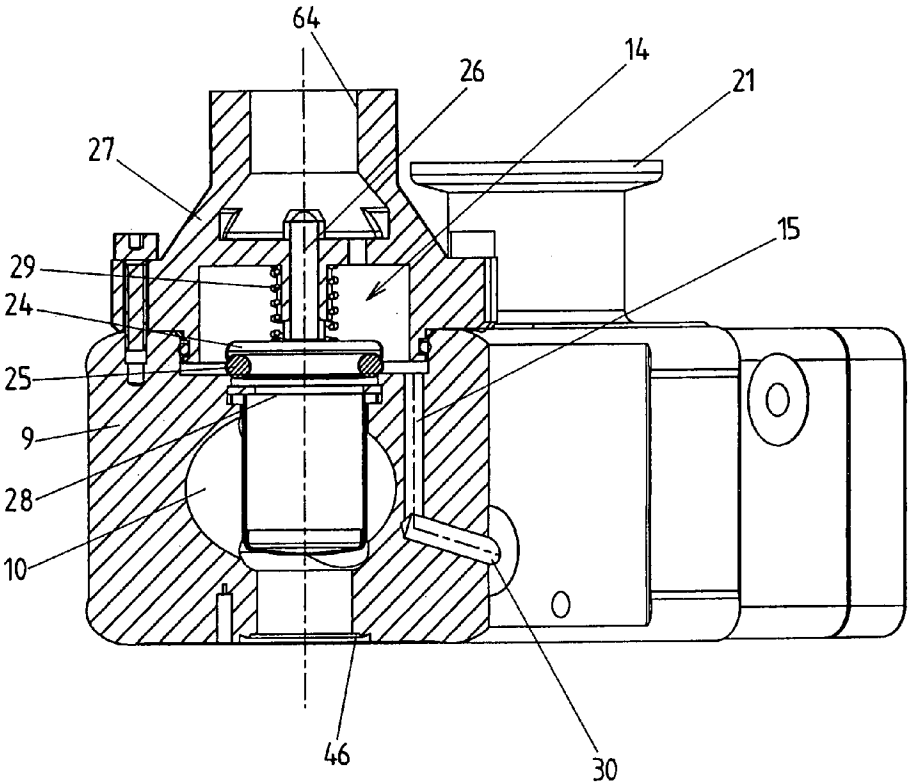
FIG. 7 shows a section along line B-B of FIG. 6.
Figure 6:
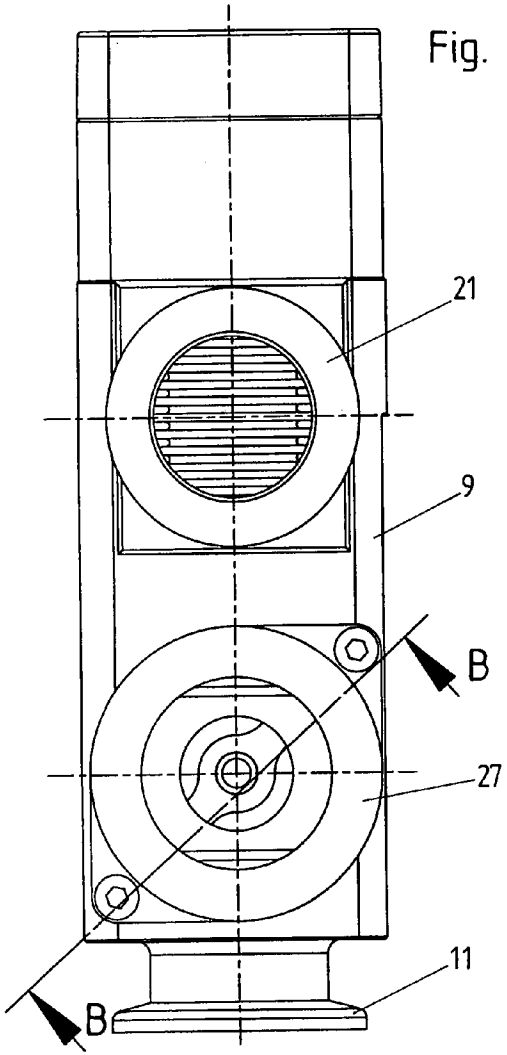
FIG. 6 is a side view of the unit shown in FIG. 4 (viewing direction D)

The shape of the portion of the dilution gas line 15 located in the body 9 can be seen most clearly in FIG. 7. This portion starts at an inlet 30 and runs through the body 9. The dilution gas line is formed by the wall of a bore hole through the body 9 and opens into the portion of the overpressure outlet channel 28 enclosed by the outlet connection piece 27.

Figure 8:
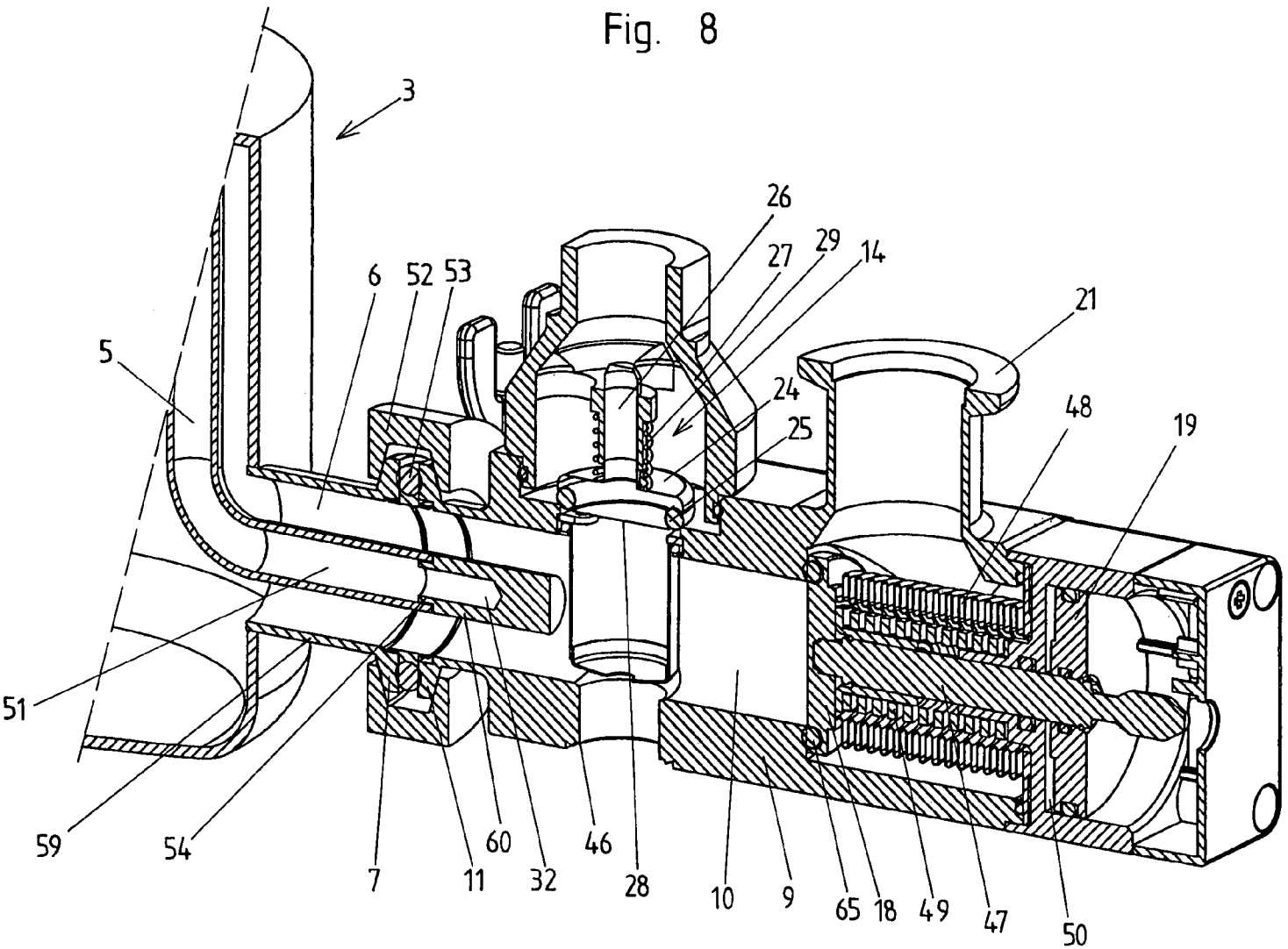
FIG. 8 is a perspective view of a longitudinal center section through the valve device connected to the backing pump connection flange of the cryopump, which latter is shown only partially and in a highly schematic manner in FIG. 8.

As can be seen most clearly in FIGS. 5 and 8, the purge gas line 12 enters the body 9 through an inlet 31 and then runs inside the body 9, for which purpose a bore hole is formed in the body 9. Subsequently, it extends as a bore hole through a connection piece 58 in a radial area of the through-channel 10. The end portion 32 of the purge gas line 12 extends inside the radial area of the through-channel 10. For this purpose, an end piece 60 having a bore hole is arranged in the through-channel 10 and is connected to the body 9 by a connection piece 58. The end portion 32 of the purge gas line 12 extends until the end of the through-channel 10 located in the connection flange 11.

In this way, a kind of pipe-within-a-pipe arrangement is provided in the end portion 32 of the purge gas line 12. The body 9 forms the outer pipe and the end portion 32 of the purge gas line is formed by the inner pipe.

In the area outside the body 9, the purge gas line 12 and the dilution gas line 15 run through the valve body 33 of the purge gas valve 13 and dilution gas valve 16 which are constructed as diaphragm valves. Actuating pistons 34, 35 are displaceably mounted in the cylinder housings 36, 37 at which are arranged actuating shafts which actuate diaphragms 38, 39. In the embodiment example shown here, springs 61, 62 act on the actuating pistons 34, 35 in the positions in which the diaphragm valves are open.

Upstream of the purge gas valve and dilution gas valve 16, the purge gas line 12 and dilution gas line 15 come together to provide a common connection 40 at the valve body 33 for supplying the purge gas and dilution gas, preferably nitrogen.

The purge gas valve 33 and dilution gas valve 16 are controlled in a conventional manner by control valves 41, 42 which are arranged at the valve body 33. Another control valve 43 which is likewise arranged at the valve body 33 serves to control the actuating member 19 for the closure member 18 (via the compressed-air line 44). Further, a compressed-air connection 45 through which the compressed air is supplied for adjusting the actuating pistons 34, 35 and actuating member 19 is provided at the valve body 33.

A connection flange 46 of the body 9 is used for connecting the pressure sensor 17 (see FIG. 1).

As can be seen particularly in FIG. 8, the closure member 18 which has a seal 65 is arranged at a valve rod 47 which projects out of the through-channel 10 through a leadthrough. Bellows 48 which are constructed as corrugated bellows and connected in a vacuum-tight manner with the closure member 18 on one side and with the body 9 on the other side serve to seal this leadthrough. A spring 49 which acts on the closure member 18 in its closed position is arranged inside the bellows 48. The closure member 18 is adjusted into its open position by supplying compressed air to the cylinder space 50.

As can be seen particularly in FIG. 8, an end portion 51 of the supply line 5 runs inside a backing pump channel 6 of the cryopump 4 and extends up to the area of the end of the backing pump channel 6 situated in the connection flange 7. The connection sleeve 59 and the end portion 51 of the supply line 5 accordingly form a kind of pipe-within-a-pipe arrangement. When the connection flange 11 of the body 9 of the valve device 8 is connected to the backing pump connection flange 7 of the cryopump 4, the end portions 51, 32 of the supply line 5 and of the purge gas line 12 are connected to one another and a continuous line is formed for the purge gas. In the present embodiment example, the backing pump connection flange 7 and the connection flange 11 are constructed as a so-called "KF flange" and are connected by connection ring 52, a sealing ring 53 of elastomer material being arranged therebetween. The end portions 51, 32 can be connected by inserting one end into the other. In the present embodiment example, the end portion 32 has a continuation 54 which can be inserted into end portion 51. A tight connection between end portion 32 and end portion 51 is not absolutely necessary and a seal, particularly a sealing ring of elastomer material, is not provided between the end portions 51, 32 in this embodiment example.

On the other hand, the connection between the end portions 51, 32 could also be constructed in a vacuum-tight manner, preferably by means of an elastomer seal which is arranged at one of the two end portions and which is pressed against a sealing surface at the other end portion when connecting the end portions 51, 32.

The insertable continuation 54 could also be dispensed with in principle and the two end portions 51, 32 could be placed against one another at their front sides in order to connect them.

The end area 5 of the supply line inside the cryopump can be constructed in a conventional manner; this is not shown exactly in the drawing and need not be described more precisely. The adsorption surfaces of the cryopump are also not illustrated in the drawing and can be constructed conventionally.

The end portions 32, 51 of the purge gas line 12 and supply line 5 are located in the area of the central longitudinal axis 55 of the through-channel 10 or in the area of the central longitudinal axis of the backing pump channel 6 in the embodiment example that is shown. Eccentric arrangements are also conceivable and possible in principle. In the present embodiment example, the connection of the end portions 32, 51 is effected in the area of the connection plane between the connection flange 11 of the body 9 and the backing pump connection flange 7 of the cryopump 4. An arrangement which is to some degree outside of this plane would also be conceivable and possible. In that case, one of the two end portions 32, 51 would project from the through-channel 10 and backing pump channel 6 and the other would be set back in a corresponding manner.

Figure 10:
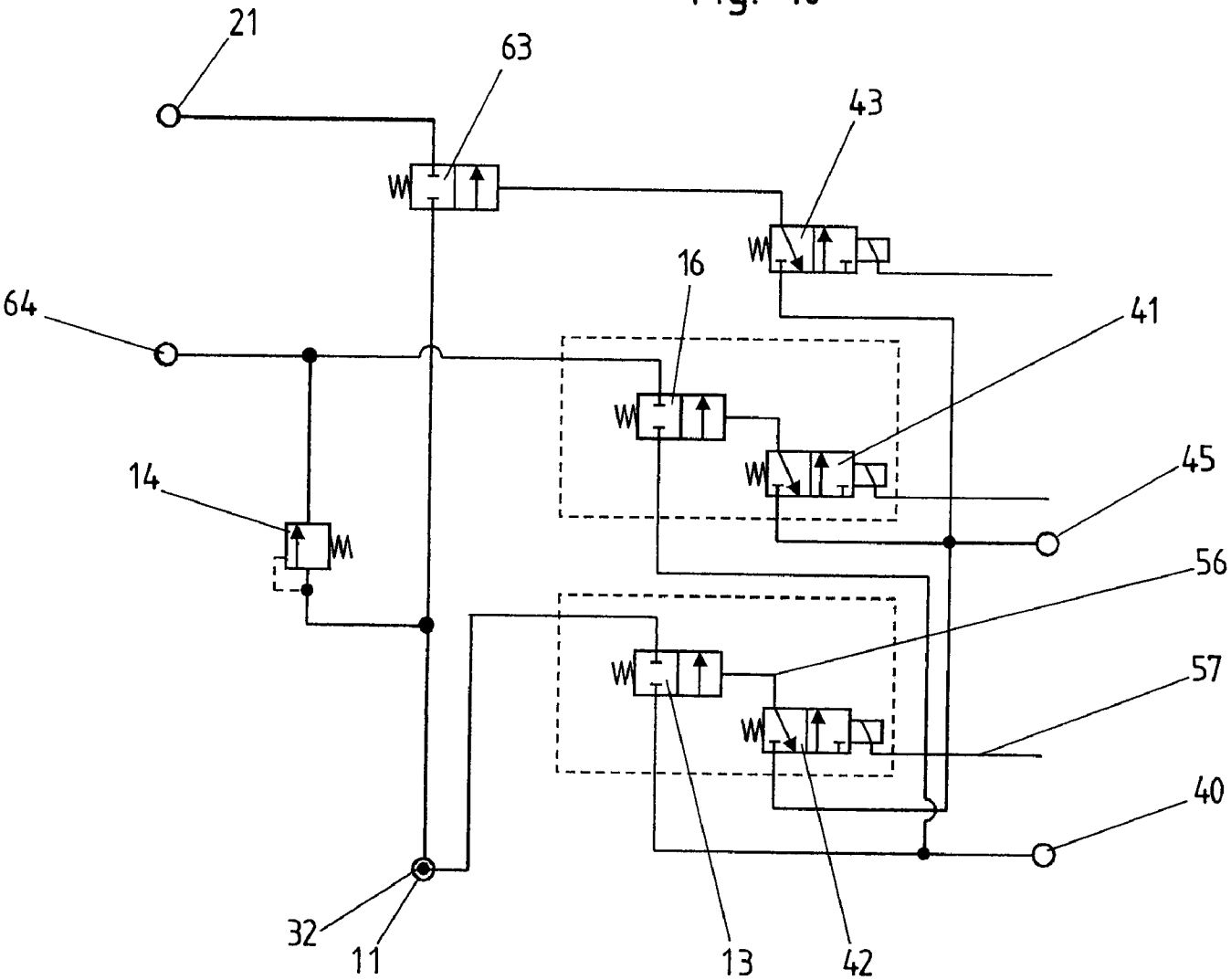
FIG. 10 shows a functional diagram for the valve.

A functional diagram of the valve device is shown in FIG. 10. The parts which were already described are provided with the same reference numbers. It can be seen from FIG. 10 that there is a common connection for the purge gas and for the dilution gas. The purge gas valve 13 which is in the closed state when compressed air is not admitted to its control line 56 is arranged in the purge gas line 12. When the control valve 41 is moved to the opened state by means of the control line 57, the control line 56 is acted upon by compressed air and the purge gas valve 13 is moved to its open state.

The dilution gas valve 16 in the dilution gas line 15 is adjusted between its closed and open state in an analogous manner by the control valve 42.

The closure member 18 of the vacuum valve 63 is also adjusted between its closed state and its open state by the control valve 43 in an analogous manner.

The pressure relief valve 14 opens when there is an overpressure above the limit value in the through-channel 10 and lets this overpressure out through the overpressure outlet channel 28 into which the dilution gas line 15 opens. The dilution gas line 15 has a smaller cross section than the overpressure outlet channel 28.

In the functional diagram according to FIG. 10, the purge gas valve 13 and the dilution gas valve 16 are shown as self-closing valves. They can also be constructed as self-opening valves and can be moved into the closed state by means of compressed air which can be supplied via the control valves 41, 42. Valves which are acted upon by compressed air in both adjusting directions are also conceivable and possible. This also applies, in principle, to the backing pump valve 58.

When carrying out a regeneration process of the cryopump 4 in which its adsorption surfaces are heated in a conventional manner, the purge gas valve 13 is opened by means of the control valve 41 and purge gas is supplied to the cryopump 4 through the purge gas line 12 and the supply line 5. The gas released during the regeneration process together with the supplied purge gas result in an overpressure in the through-channel 10. At a determined value of this overpressure, for example, at a pressure of 0.2 bar above atmospheric pressure, the pressure relief valve 14 opens. The dilution gas valve 16 can be actuated by means of the control valve 42 depending upon the pressure in the through-channel 10 which is detected by the pressure sensor 17. In this respect, the dilution gas valve 16 can be opened at a pressure somewhat below the opening pressure of the pressure relief valve 14.

The cut-off valve 2 is closed during the regeneration process and the closure member 18 is in its closed position.

Various modifications of the embodiment example described herein are conceivable and possible without departing from the field of the invention. For example, instead of a corner valve, a straight valve could also be formed by means of the body 9 with the closure member 18 adjustably supported therein. It would also be conceivable and possible that the valve device 8 does not form a fore-valve, i.e., there is no a closure member 18 adjustably mounted in the body 9 by which the through-channel 10 can be closed. In this case, the valve device 8 can form an intermediate piece and a fore-valve by which the backing pump is closed can be connected to its connection flange arranged on the side remote of the cryopump 4. However, an embodiment form of this kind is less preferable due to the greater number of parts required.

When a sufficient dilution of the gas escaping during the regeneration process of the cryopump is achieved by means of the purge gas, the purge gas line 12 and the purge gas valve 13 could also be dispensed with.

Instead of adjusting the actuating pistons 34, 35 and the actuating member 19 by means of compressed air, this adjustment could also be carried out by means of another gas under pressure, particularly nitrogen.

As will be appreciated from the preceding description, the field of the invention is not limited to the embodiment examples shown herein, but rather should be defined with reference to the appended claims together with their full range of possible equivalents.

REFERENCE NUMBERS

1 pump arrangement
2 cut-off valve
3 vacuum chamber
4 cryopump
5 supply line
6 backing pump channel
7 backing pump connection flange
8 valve device
9 body
10 through-channel
11 connection flange
12 purge gas line
13 purge gas valve
14 pressure relief valve
15 dilution gas line
16 dilution gas valve
17 pressure sensor
18 closure member
19 actuating member
20 valve seat
21 connection flange
22 backing pump
23 line piece
24 valve disk
25 sealing ring
26 valve stem
27 outlet connection piece
28 overpressure outlet channel
29 spring
30 inlet
31 inlet
32 end portion
33 valve body
34 actuating piston
35 actuating piston
36 cylinder housing
37 cylinder housing
38 diaphragm
39 diaphragm
40 connection
41 control valve
42 control valve
43 control valve
44 compressed-air line
45 compressed-air connection
46 connection flange
47 valve rod
48 bellows
49 spring
50 cylinder space
51 end portion
52 connection ring
53 sealing ring
54 continuation
55 longitudinal axis
56 control line
57 control line
58 connection piece
59 connection sleeve
60 end piece
61 spring
62 spring
63 vacuum valve
64 connection
65 seal

What is claimed is:

1. A valve device for connecting to a cryopump comprising:

a body with a through-channel and a connection flange at one end of the through-channel for connecting to a backing pump connection flange of the cryopump;

a pressure relief valve which opens when an overpressure in the through-channel exceeds a limiting valve and which lets this overpressure out of the through-channel;

a purge gas line in which a purge gas valve is arranged and which serves to supply a purge gas to a supply line of the cryopump during a regeneration process of the cryopump;

wherein an end portion of the purge gas line by which the purge gas line can be connected to the supply line of the cryopump runs within the through-channel to the area of the end of the through-channel situated in the connection flange wherein the valve device comprises a dilution gas line in which a dilution gas valve is arranged, wherein a dilution gas flowing out of the dilution gas line can be mixed with the gas flowing out through the pressure relief valve when the dilution gas valve is open.

2. The valve device according to claim 1 wherein the pressure relief valve is arranged in an overpressure outlet channel which proceeds from the through-channel and into which the dilution gas line opens.

3. The valve device according to claim 2, wherein an outlet connection piece through which the overpressure outlet channel runs is arranged at the body of the valve device.

4. A valve device for connecting to a cryopump comprising:

a body with a through-channel and a connection flange at one end of the through-channel for connecting to a backing pump connection flange of the cryopump;

a pressure relief valve which opens when an overpressure in the through-channel exceeds a limiting valve and which lets this overpressure out of the through-channel;

a purge gas line in which a purge gas valve is arranged and which serves to supply a purge gas to a supply line of the cryopump during a regeneration process of the cryopump;

wherein an end portion of the purge gas line by which the purge gas line can be connected to the supply line of the cryopump runs within the through-channel to the area of the end of the through-channel situated in the connection flange wherein the body has another connection flange at the other end of the through-channel for connecting to a backing pump.

5. The valve device according to claim 4, wherein a closure member is adjustably mounted in the body, and the through-channel can be closed and opened by the closure member.

6. The valve device according to claim 5, wherein the body with the through-channel and the closure member which is adjustably arranged in the through-channel are constructed in the manner of a corner valve.

7. The valve device according to claim 5, wherein the closure member is adjustable between its open position and its closed position by an actuating member.

8. The valve device according to claim 7, wherein the actuating member is a piston-cylinder unit.

9. The valve device according to claim 1, wherein the valve device has a control valve for controlling the purge gas valve.

10. The valve device according to claim 1, wherein the valve device has a control valve for controlling the dilution gas valve.

11. The valve device according to claim 7, wherein the valve device has a control valve for controlling the actuating member.

12. The valve device according to claim 1, wherein the purge gas valve is arranged at the body.

13. The valve device according to claim 1 wherein the dilution gas valve is arranged at the body.

14. The valve device according to claim 1, wherein the end portion of the purge gas line lies in the area of the central longitudinal axis of the through-channel.

15. A pump arrangement with a cryopump which has a backing pump connection flange and with a valve device connected to the backing pump connection flange, comprising:

a body of the valve device with a through-channel and a connection flange at one end of the through-channel for connecting to the backing pump connection flange of the cryopump;

a purge gas line of the valve device in which a purge gas valve is arranged and which serves to supply a purge gas to a supply line of the cryopump during a regeneration process of the cryopump;

wherein an end portion of the purge gas line runs within the through-channel of the body of the valve device, and wherein the end portion of the purge gas line is connected to an end portion of the supply line when the connection flange of the body is connected to the backing pump connection flange of the cryopump, and a continuous line is formed for the purge gas, wherein the valve device has a pressure relief valve which opens when there is an overpressure in the through-channel lying above a limiting valve and lets this overpressure out of the through-channel, wherein the valve device has a dilution gas line in which a dilution gas valve is arranged, wherein a dilution gas flowing out of the dilution gas line can be mixed with the gas flowing out through the pressure relief valve when the dilution gas valve is open.

16. The pump arrangement according to claim 15, wherein the end portion of the supply line runs inside the backing pump channel of the cryopump and extends up to the area of the end of the backing pump channel situated in the backing pump connection flange.

17. The pump arrangement according to claim 15, wherein the end portion of the purge gas line and the end portion of the supply line can be inserted one inside the other to form a continuous line for the purge gas.

18. The pump arrangement according to claim 15, wherein the valve device is connected to a backing pump.

19. The pump arrangement according to claim 15 wherein the pressure relief valve is arranged in an overpressure outlet channel which proceeds from the through-channel and into which the dilution gas line opens.

20. The pump arrangement according to claim 15, wherein a closure member is adjustably mounted in the body, and the through-channel can be closed and opened by means of the closure member.

21. A valve device according to claim 20, wherein the body with the through-channel and the closure member which is adjustably arranged in the through-channel are constructed in the manner of a corner valve.

22. The pump arrangement according to claim 15, wherein the purge gas valve is arranged at the body.

23. The pump arrangement according to claim 15 wherein the dilution gas valve is arranged at the body.

24. The pump arrangement according to claim 15, wherein the end portion of the purge gas line is connected in a vacuum-tight manner with the end portion of the supply line when connecting the connection flange of the body to the backing pump connection flange of the cryopump.

* * * * *